US005786756A

United States Patent [19]

Piller

[11] Patent Number: 5,786,756

[45] Date of Patent: Jul. 28, 1998

[54] METHOD AND SYSTEM FOR THE PREVENTION OF FALSE ALARMS IN A FIRE ALARM SYSTEM

[75] Inventor: Bernhard Piller, Morges, Switzerland

[73] Assignee: Cerberus AG, Switzerland

[21] Appl. No.: 347,120

[22] Filed: Nov. 23, 1994

[30] Foreign Application Priority Data

Nov. 23, 1993 [CH] Switzerland ..... 03 487/93

[51] Int. Cl.[6] ..... G08B 29/00

[52] U.S. Cl. ..... 340/507; 340/511; 340/589; 340/286.05; 340/661; 364/557

[58] Field of Search ..... 340/507, 506, 340/511, 587–589, 661, 286.05; 364/550, 557

[56] References Cited

U.S. PATENT DOCUMENTS

| | | | |
|---|---|---|---|
| 4,459,583 | 7/1984 | van der Walt et al. | 340/511 |
| 4,598,271 | 7/1986 | Wägli et al. | 340/511 |
| 4,644,331 | 2/1987 | Matsushita et al. | 340/511 |
| 4,727,359 | 2/1988 | Yuchi et al. | 340/511 |
| 4,749,986 | 6/1988 | Otani et al. | 340/511 |
| 4,749,987 | 6/1988 | Ishii | 340/511 |
| 4,764,755 | 8/1988 | Pedtke et al. | 340/541 |

FOREIGN PATENT DOCUMENTS

| | | |
|---|---|---|
| A 2542116 | 9/1984 | France . |

*Primary Examiner*—Donnie L. Crosland

*Attorney, Agent, or Firm*—Burns, Doane, Swecker & Mathis, L.L.P.

[57] ABSTRACT

A fire alarm system comprises detectors with sensors for monitoring fire index quantities. The sensors generate corresponding sensor signals which are delivered to an analysis stage, in which the probability of a future false alarm is assessed and, if a defined magnitude of probability exists, an information signal is produced.

11 Claims, 2 Drawing Sheets

METHOD AND SYSTEM FOR THE PREVENTION OF FALSE ALARMS IN A FIRE ALARM SYSTEM

FIELD OF THE INVENTION

This invention concerns a method and system for the prevention of false alarms in a fire alarm system, of the type in which a number of detectors are connected to a control center, with the detectors having one or more sensors for monitoring fire index quantities and for emitting corresponding sensor signals from which hazard signals are derived in a signal processing operation.

BACKGROUND OF THE INVENTION

One of the causes of false alarms, which rank among the most frequently occurring malfunctions in fire safety systems, is that the sensors "make mistakes" when they are incapable of distinguishing between a fire index quantity which indicates a fire and a parameter which only simulates a fire. The main reason for this confusion is that the two quantities are the same physically but of different origins so that, for example, in a particular room the physical quantity "smoke" can be caused either by a fire, a cigar smoker or by welding work. As a result, if the appropriate detector responds to the fire index quantity smoke, then it will do so in each of the three cases, and increasing the reliability of the sensor or individual components in the sensor will not prevent the triggering of false alarms caused by the cigar smoker or the welding work. Known systems, however, are directed almost exclusively towards such improvement of reliability, with the result that they are generally incapable of reducing the number of false alarms of the type described.

The object of the invention is to define a method by the application of which false alarms are largely prevented or, at least, appreciably reduced, as well as a fire alarm system whose operation is based on such a method.

SUMMARY OF THE INVENTION

This object is achieved in accordance with the invention by means of a signal processing operation that includes the following stages:

a. Analysis of the sensor signal during a defined first interval;

b. Calculation of the probability of a false is alarm in a subsequent second interval; and c. Emission of an information signal if the probability exceeds a defined value.

The approach adopted in the method of the invention for preventing false alarms differs completely from any employed hitherto. No attempt is made to reduce the number of false alarms by increasing the reliability of the system or its components; instead, the system is designed so that false alarms can be predicted. When the probability of a future false alarm attains or exceeds a defined value, the user receives an information signal or a warning to which he can react as appropriate.

A major concern in a method or system of this type is the relationship between the time required for the decision on whether a warning is to be given and the reliability of this decision. That is to say, on one hand, the decision must be made within as short a time as possible, since a false alarm usually occurs shortly after a change in the ambient conditions and, on the other hand, the statistical significance of the data gathered during this short period is not high, nor can it be by any means.

This problem of assessing the probability of a false alarm using only a very small amount of data is solved by a preferred further development of the method according to the invention in that the length of the second time segment is of the same order of magnitude as that of the first, that each time segment is divided into part-intervals and the mean value of the signal maximum values is determined for each part-interval, and a distribution function of the probability of a false alarm is derived from this mean value.

One of the main applications of the method of the invention is that of so-called incorrect application detection, whereby possible incorrect applications are to be brought to the attention of the user. This function is performed by another preferred further embodiment of the method according to the invention in that, instead of the calculation of the probability in stage b, a threshold value is set, the sensor signals are compared with this threshold value and the excursions above the threshold value are recorded and, if these exceed a defined number, an incorrect application signal is given.

The invention also concerns a fire alarm system for the implementation of the method described, with a control center to which are connected detectors that possess sensors for fire index quantities and emit corresponding sensor signals, and with means for processing these sensor signals.

The fire alarm system according to the invention is characterized in that the means for processing the sensor signals include means for recording the sensor signals during the first interval, means for comparing the sensor signals with a threshold value and means for recording the excursions of the sensor signals above the threshold value.

BRIEF DESCRIPTION OF THE DRAWINGS

The invention will now be explained in greater detail, with reference to embodiments and the following drawings, in which.

DETAILED DESCRIPTION

Figure 1:
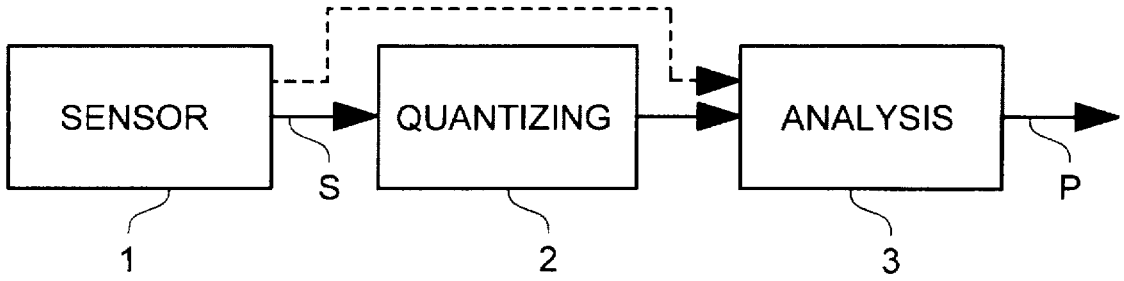
FIG. 1 is a block diagram of the signal processing system.

In FIG. 1, reference number 1 denotes the sensor, or a sensor, of a fire alarm system at the output of which a sensor signal S is obtained. Reference number 2 denotes a block 2 within which the sensor signals S are quantized, i.e., the continuous sensor signal is sampled. Reference number 3 denotes a signal analysis stage, at the output of which is obtained a signal P, which indicates the probability of a false alarm. Normally, the sensor signals are not analyzed remotely at the site of the detector, but in a control center (not shown), to which the detectors containing the sensors 1 are connected. Preferably, therefore, the analysis stage 3 is located at the control center. This stage may receive signals from a number of sensors, or a separate analysis circuit can be provided for each sensor in the system. It is not significant whether the control center receives the sensor signal S in a quantized form or not; in the latter case, the signal can be quantized in the control center, as indicated in the drawing by a cable, denoted by the broken line, directly connecting the sensor 1 with the analysis stage 3.

Figure 3:
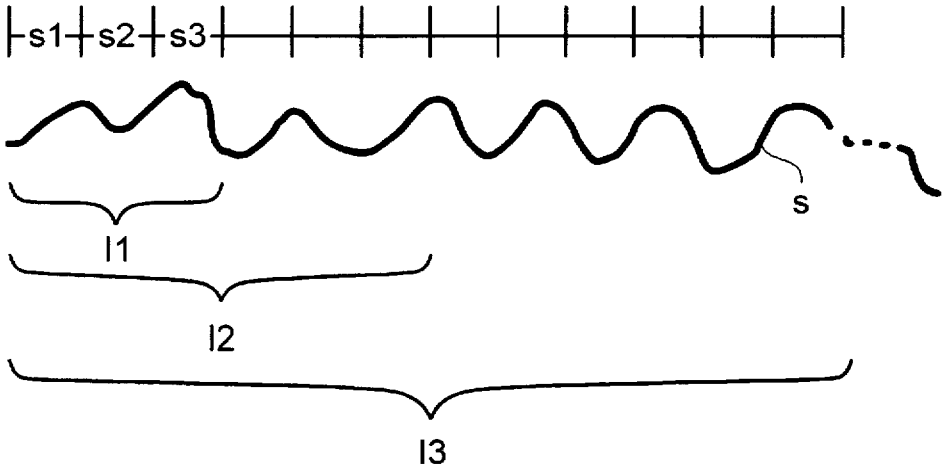
FIG. 3 is a timing diagram showing various intervals and sub-intervals.

In the analysis stage 3, an interval is first defined over which the sensor signal is to be analyzed. The length of this interval can vary within a range of minutes, days, weeks or even months. It is preferable that not just one interval be defined, but rather a series of intervals of differing lengths. Referring to FIG. 3, this is achieved by dividing an interval into sub-intervals $s_1$, $s_2$, $s_3$ and so on, so that an interval scale is obtained in the majority of cases, the sensor signal being analyzed within each of the variously scaled sub-intervals. The intervals of differing lengths can be formed by different multiples of the sub-intervals, as represented by I1, 12, I3, etc. Each of the sub-intervals $s_n$ is preferably of the same length.

A second interval, preferably of the same length as the first, or an interval scale having the same lengths as the first interval scale, is then defined and the result from the analysis of the sensor signal in the separate sub-intervals of the first interval is transferred to the corresponding sub-intervals of the second interval. The function of this stage is to determine whether, from the behavior or progression of the signal in a first interval, it is possible to derive an index of the possibility of a false alarm being tripped in the corresponding second interval, and to determine the magnitude of probability.

A major precondition for inferring the behavior of the sensor signal S in a second interval from its behavior in a first interval is the presence of a stationary state. It is assumed that stationary states prevailed during the analysis and recording of the signal, and that this will also be the case in the future, during the second interval.

Definition of intervals of varying lengths is recommended because the weighting of a signal with respect to its significance for a possible alarm is highly dependent on the time reference. Thus, for example, if 20 events, i.e., excursions above a given threshold value, occur on one single day then, relative to an interval having a length of one day, this represents 20 separate events. Relative to an interval of six months or a year, however, this represents a frequency of events which cannot in any way be considered to be unconnected with each other.

To ensure that one event is not counted more than once, only the event with the greatest amplitude, MAX $S_i$, in each sub-interval $s_i$ is taken into account in the analysis, in stage 3, of the intervals composed of several sub-intervals. A consequence of this is that, in a given sub-interval, all events having amplitudes below the maximum are disregarded, but this is not critical because these events will likely be detected in shorter intervals and sub-intervals. A representative mean value for a particular interval is then derived from the maximum values for each of the sub-intervals, i.e., $$1/N \sum_{i=1}^{N} \text{MAX } S_i.$$

The probability of a false alarm is then deduced from this mean value.

If it is assumed that the distribution function of this probability is an exponential function and if an interval having a length T is divided into sub-intervals and the parameter λ of the normalized distribution function $f(\lambda, x)=\lambda\exp(-\lambda x)$ is calculated from the mean value of the signal maximum values in the sub-intervals, then the probability P of a false alarm during a sub-interval m and for a given threshold value L is given by $$P\,(T/m,\ L)\ \int\lambda exp\ (-\lambda x)=exp\ (-\lambda L)$$

(integral of L to infinity)

The probability of avoidance of a false alarm during a sub-interval is:

$$\bar{P}(T/m,\ L)=1-e^{-\lambda L}$$

During the total interval, the probability of avoidance of a false alarm is:

$$\bar{P}(T,\ L)=(1-e^{-\lambda L})^m$$

In practice, the user determines the extent to which the system should prevent false alarms. For example, if 9 out of 10 false alarms are to be prevented, then P is made equal to 0.9. The value and the number m of sub-intervals defines the condition for the emission of a warning by the system $$\text{Warning if: } \lambda L \geqq \ln\,[1-P^{1/m}(T,L)]$$

For P=0.9 and 10 sub-intervals, the ratio of the threshold value L to the mean value 1/λ is calculated as:

$$\lambda L=-\ln\,(1-0.9^{1/10})=4.55$$

This result means that the mean value of the data gathered in a given interval should not exceed 22% of the alarm threshold value if the system is to prevent a false alarm with a probability of 0.9.

In a practical application, the bandwidth of the intervals is selected so that the shortest interval is defined by the shortest reaction time of a user, typically 10 minutes, and the longest interval is defined by the maximum anticipated duration of the stationary states, for example 6 months. If, starting from the shortest interval, each of the interval lengths are doubled, as shown in FIG. 3, this gives 15 intervals, from 10 minutes to 6 months. The mean values for each interval are obtained by filtering the maximum values of the sub-intervals using a digital low-pass filter. For each interval, this mean value is stored in memory together with the provisional maximum value in each case.

The algorithm for the warning is very simple: the system calculates the mean values and checks whether these exceed a given threshold value corresponding to the probability P of avoiding a false alarm. This threshold value can differ for each interval. If, as stated above, 9 out of 10 false alarms are to be prevented then, as soon as the system ascertains that the mean value has exceeded a value of 22% of the threshold value within an interval of, for example, one hour, it emits an information signal and requests an intervention within the next hour. If the interval was 1 month, then a different type of information signal would be given because intervention would not be so urgent.

Figure 2:
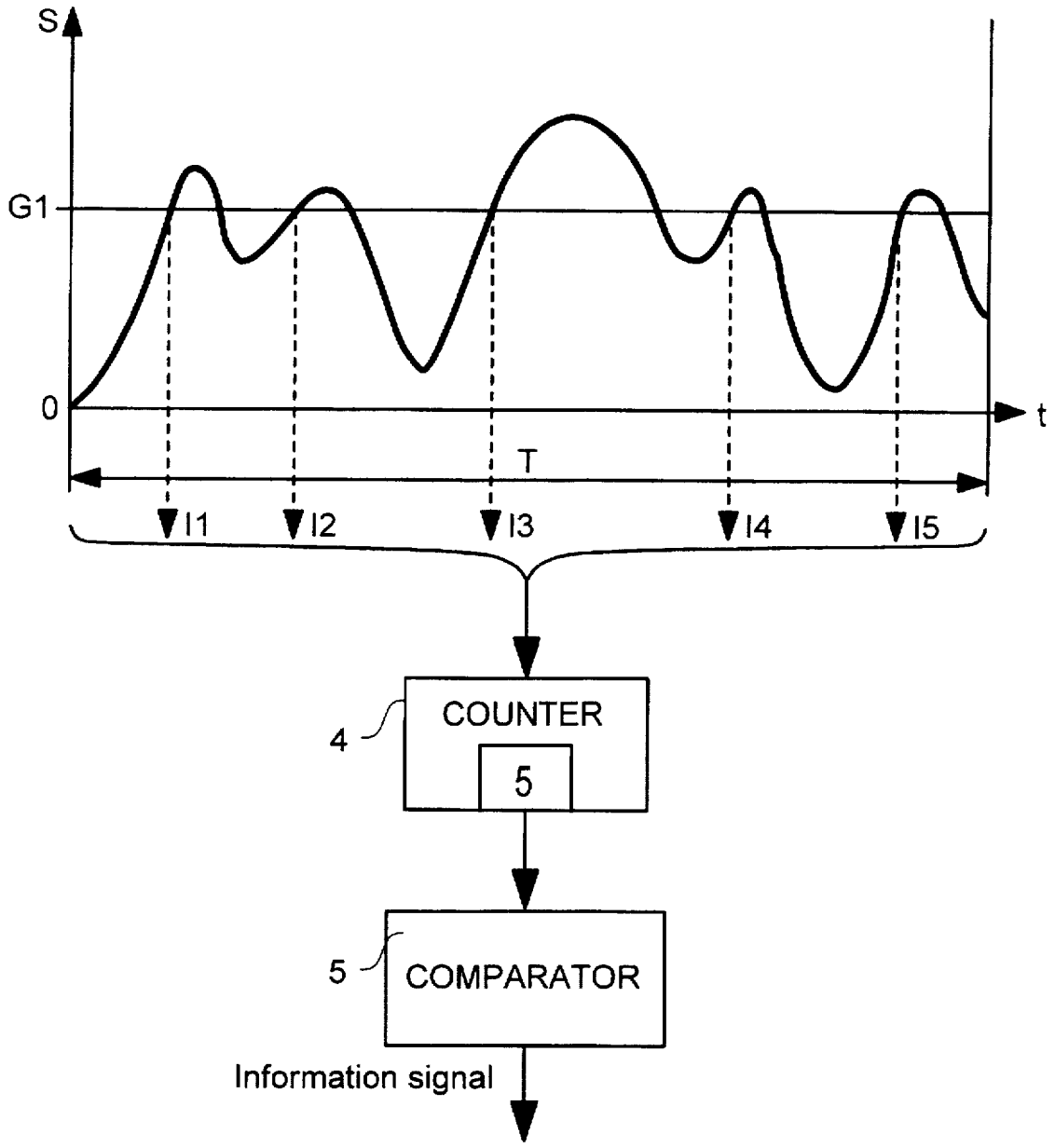
FIG. 2 is a diagram explaining a special function, the so-called incorrect application detection.

FIG. 2 shows an embodiment of a very simple function of the method according to the invention. This function is a so-called incorrect application detection or alarm, whereby possible incorrect applications are to be brought to the attention of the user. The basic concept is that the system determines automatically whether and how frequently a detector exceeds a defined hazard level within a defined interval without tripping an alarm, as there is then a risk of a false alarm being tripped at any time.

The top half of FIG. 2 shows the graph of a sensor signal S plotted over the time t, a threshold value G1 being indicated on the ordinate for the low hazard level mentioned. A detector counts each excursion above the threshold value G1 and delivers a corresponding pulse In to a counter 4. The counter 4 counts the pulses In over the selected time interval T, for example 24 hours and, at the end of the time interval, relays the counter status, which is 5 in the example illustrated, to a comparator 5. This compares the received counter status with a set value and, if this value is exceeded, it emits an "inappropriate application" or similar information signal.

The embodiment illustrated can be further developed in that, for example, the signal S can be quantized. This result can then be used to determine the duration of the excursion above the threshold value G1 by the signal S. Obviously, other higher hazard levels can be used for incorrect application detection, with excursion above these hazard levels also being used for the information signal.

What is claimed is:

1. A method for preventing false alarms in a fire alarm system of the type comprising detectors having one or more sensors for monitoring fire index quantities and for emitting corresponding sensor signals from which hazard signals are derived in a signal processing operation, comprising the steps of:

analyzing a sensor signal during a defined first interval;

calculating the probability of a false alarm in a subsequent second interval; and generating a warning signal to indicate the likelihood of a false alarm if the probability exceeds a defined value.

2. The method according to claim 1, wherein the length of the second interval is approximately equal to that of the first interval.

3. The method according to claim 2, wherein the sensor signal is analyzed over a number of intervals of differing lengths.

4. The method according to claim 1, wherein each interval is divided into a number of sub-intervals of equal length.

5. The method according to claim 4, wherein said analyzing step comprises the steps of determining the maximum value of the sensor signal in each sub-interval and calculating a mean value for the particular interval from the maximum values of all sub-intervals.

6. The method according to claim 5, wherein a threshold value is defined, based on the extent to which false alarms are to be prevented, and the information signal is emitted if the mean value exceeds the threshold value.

7. A false alarm indicator for a fire alarm system, comprising:

detectors having sensors for fire index quantities which generate corresponding sensor signals, and means for processing the sensor signals, including means for recording the sensor signals during a first time interval, means for comparing the sensor signals with a threshold value, means for recording the excursions of the sensor signals above the threshold value, and means for generating a false alarm warning signal when the recorded excursions exceed a preset number.

8. The fire alarm system according to claim 7, wherein said means for processing the sensor signals comprises means for dividing said first time interval into sub-intervals of equal length, means for determining the maximum values of the sensor signal in the sub-intervals and means for deriving an interval mean value from the maximum values.

9. The fire alarm system according to claim 8, wherein the means for deriving the interval mean value comprises a digital low-pass filter.

10. A method for preventing false alarms in a fire alarm system, comprising the steps of:

detecting a fire index parameter and measuring the magnitude of said parameter;

establishing a threshold value for said magnitude;

counting the number of times the measured magnitude exceeds said threshold during a predetermined time interval; and generating a false alarm-related signal if the counted number is greater than a predefined value.

11. The method of claim 10 further including the step of determining the length of time the measured magnitude exceeds said threshold.

* * * * *